United States Patent [19]

Cadenhead, Sr.

[11] Patent Number: 4,834,049

[45] Date of Patent: May 30, 1989

[54] HEAT RECLAIMING SYSTEM

[75] Inventor: Roy A. Cadenhead, Sr., Calhoun, Ga.

[73] Assignee: Modern Fibers Incorporated, Calhoun, Ga.

[21] Appl. No.: 221,361

[22] Filed: Jul. 19, 1988

[51] Int. Cl.[4] ..... F22D 1/00

[52] U.S. Cl. ..... 122/438; 237/67

[58] Field of Search ..... 122/438, 412, 442, 443; 237/56, 67, 68, 69

[56] References Cited

U.S. PATENT DOCUMENTS

| | | | |
|---|---|---|---|
| 331,307 | 12/1885 | Lee . | |
| 622,805 | 4/1899 | Howard . | |
| 694,206 | 2/1902 | Smead . | |
| 2,515,648 | 7/1950 | Hunt et al. | 122/442 X |
| 2,903,187 | 9/1959 | Coykendall | 237/8 |
| 3,022,985 | 2/1962 | Mair | 261/151 |
| 4,602,672 | 7/1986 | Kaufmann | 165/1 |
| 4,660,511 | 4/1987 | Anderson | 122/420 |

OTHER PUBLICATIONS

King, "Practical Marine Engineering", 1956, pp. 341-349.

*Primary Examiner*—Henry Bennett

*Attorney, Agent, or Firm*—Sutherland, Asbill & Brennan

[57] ABSTRACT

In an industrial plant having a boiler and water cooled equipment, the two water systems are linked by means of a heat reclamation vessel having connecting upper and lower chambers. Tap water (e.g., at 60°-70° F.), after being used to cool equipment such as vacuum pumps, which causes the water to heat to 90°-105° F., is continuously delivered to the lower chamber of the vesel, near the bottom, where the water may, for example, have a temperature of about 95°-110° F. Spent steam (e.g., at a temperature of about 230°-280° F.) is continuously released in the upper chamber, where it is sprayed with water withdrawn from near the bottom of the lower chamber. The steam condenses and the condensate collects in the pool in the lower chamber. The water in the upper zone of the pool is kept at a higher temperature due to the collection there of the steam condensate. That water, e.g., at a temperature of about 185°-200° F., is continuously drawn off and used as boiler feedwater.

18 Claims, 1 Drawing Sheet

"CITY" WATER
COOLED EQUIPMENT (CHILLERS, AIR COMPRESSORS, VAC. PUMPS, ETC.)
RETURNED COOLING WATER
MAKE-UP "CITY" WATER
SOL.
WATER SOFTENER
WATER LEVEL SENSOR
WATER LEVEL SENSOR
WASTE STEAM
TO SPRAY BARS
OVERFLOW
TO BOILER

HEAT RECLAIMING SYSTEM

This invention concerns a system for reclaiming heat from spent steam in a plant in which cool fresh water also is used to cool equipment such as vacuum pumps, chillers, and air compressors.

Many industrial plants are equipped with steam boilers and water cooled equipment. Typically, the boiler is fed by tap water that has been passed through a heat exchanger to preheat the water with the spent steam. The water used to cool equipment normally is circulated in a separate system. Tap water again is used. After passing through the equipment to be cooled, this water typically is sent to an evaporative cooling tower and then is recirculated. The present invention modifies such systems to achieve savings in energy used to produce the steam and in water used to cool the equipment.

The system of the present invention includes a heat reclaiming vessel comprising a lower chamber for holding a pool of water and an upper chamber for condensing steam. The upper chamber is located above the lower chamber and is also open to the lower chamber. The vessel is vented to the atmosphere. The system includes means for conducting water from the cooled equipment to the lower chamber of the heat reclaiming vessel. Preferably the warmed tap water from the cooled equipment will be delivered to a zone in the bottom half of the vessel's lower chamber. The system also includes means for conducting the spent steam to the upper chamber and releasing it therein, as well as means for conducting water from a zone in the bottom half of the lower chamber to the upper chamber and there spraying the released steam with the water from the lower chamber. The spray water is released in sufficient quantity to cause a substantial portion of the steam to condense. The condensate falls into the pool of water in the lower chamber. Because it is warmed substantially by the condensation of the spent steam, the water in the upper zone of the lower chamber is at a substantially higher temperature than that in the lower zone. The system also includes means for conducting this higher temperature water in the upper zone of the lower chamber to the boiler.

The spray means in the upper chamber of the reclaiming vessel preferably are operable to create two spaced-apart curtains of spray in the upper chamber, and the means for conducting the spent steam to the upper chamber advantageously is operable to release that steam in the region lying between the two curtains of spray. The spray equipment may advantageously include a first pair of horizontal pipes mounted on opposite interior walls of the upper chamber, above the steam release region, and a second pair of opposed horizontal pipes mounted below the steam release region. Each such pipe should have one or more spray openings that face the opposite wall of the chamber. Preferably the spray openings are directed about 20 to 30 degrees below horizontal. Preferably each spray bar has a slotted spray opening along its length. It also is preferred that the upper chamber have a rectangular cross section and that the upper pair of spray bars be mounted on one set of walls and the lower pair of spray bars be mounted on the other set of walls. In this embodiment it is preferred that the means for conducting the spent steam to the upper chamber terminate in a vertical length of pipe that is open at the bottom, substantially halfway between the two pairs of spray bars.

Preferably the spent steam released in the upper chamber of the reclaiming vessel will be saturated steam at a temperature no higher than about 280° F., e.g., at about 230° to 280° F. Usually a plant will have a number of spent steam lines. These can be combined and the steam carried in a single line to the upper chamber of the reclaiming vessel, or a pluarlity of separate spent steam lines can be directed into the chamber.

The system preferably includes tank means for collecting and holding the warmed water expelled from the water cooled equipment, prior to conducting that water to the lower chamber of the vessel described. The warmed water should be at a temperature below 212° F., e.g., at about 90° to 105° F. It also is preferred that the system include means for softening the warmed water prior to conducting it to the vessel.

The used cooling water and the spent steam preferably are chemically analyzed to determine whether either contains contamination that may be harmful to either the boiler or to any product the live steam might contact, e.g., as in an autoclave. (The steam, of course, must be condensed in order to be analyzed.) If troublesome contamination does exist, the system preferably will contain suitable purification means.

The present system can obviate the need for either an evaporative cooling tower or a tubular heat exchanger for the boiler feedwater. The invention allows one to use only fresh tap water to cool the plant equipment that requires water cooling. This allows the equipment to run cooler, and therefore last longer. In systems in which the cooling water is recirculated after being sent through an evaporative cooling tower, the water coming from the tower still is generally about 10 to 15 degrees warmer than the tap water. Water savings can be realized due to the fact that in a typical evaporative cooling tower about 25 percent of the cooling water is lost per cycle through evaporation.

In many plants cooling water is released in the sewer system rather than recirculated through a cooling tower, because the amount of water used is considered too small to warrant the expense of a cooling tower. The present invention provides even greater water savings when compared to that type of system.

Additional energy savings can be realized through the recapture of the heat in the spent steam. If one were to use only 60°-70° F. water as boiler feed, after being warmed in the heat exchanger the water may typically reach a temperature of about 160° F. In the present system, more of the heat of the spent steam is reclaimed and the boiler feedwater may reach a temperature in the range of about 185° to 200° F. This provides for substantial fuel savings at the boiler.

The invention will be better understood by considering the drawings accompanying this specification:

Figures 1, 2, 3:
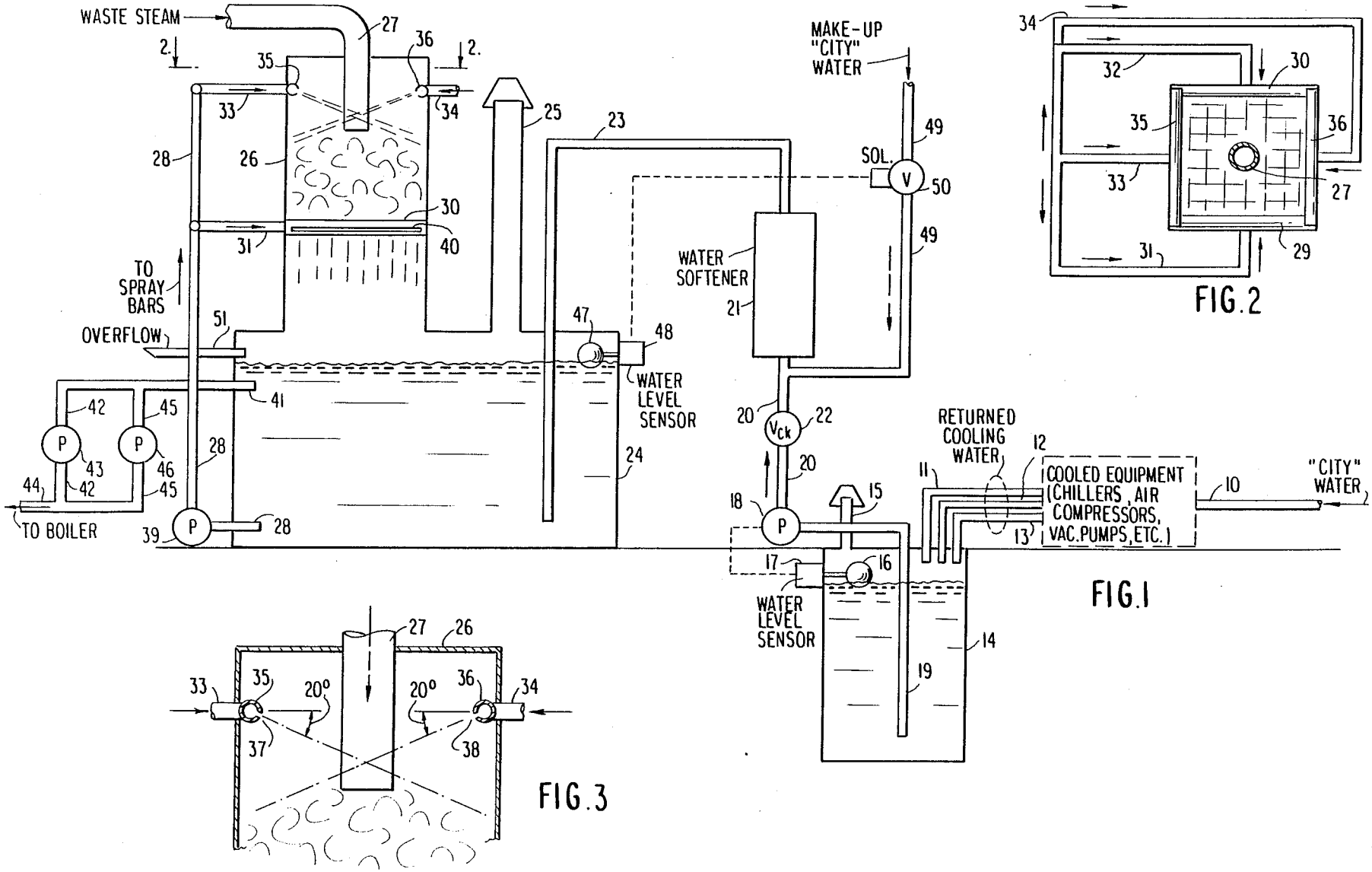
FIG. 1 is a schematic representation of a system embodying the present invention.
FIG. 2 is a top cross-sectional view, taken along the line 2—2 in FIG. 1, of the upper chamber shown in FIG. 1, together with the piping that supplies the upper chamber.
FIG. 3 is an enlarged view of the top half of the upper chamber as shown in FIG. 1.

Referring to the drawings, cool tap water, at a temperature of about 60° to 70° F., enters the system through supply pipe 10 and is used to cool miscellaneous equipment such as chillers, air compressors, and vacuum pumps. The water leaves the cooled equipment via lines 11, 12, and 13 at a temperature about 20 to 45

Fahrenheit degrees higher than in line 10 (e.g., at about 90°-105° F.) and runs into holding tank (or "sump") 14, which is a covered fiberglass tank buried in the ground. Tank 14 is open to the atmosphere via vent pipe 15.

When the warmed water in storage tank 14 reaches the level of float 16, sensor 17 generates an electrical signal that activates pump 18, which pumps water from near the bottom of tank 14, through lines 19 and 20, to water softener 21. Check valve 22 prevents backflow in line 20. After passing through softener 21, the warmed water is delivered to holding tank 24 through line 23, which opens near the bottom of tank 24. Tank 24 is open to the atmosphere through vent pipe 25.

Spent saturated steam, for example at a temperature of about 230° to 280° F., is supplied to square condensing tower 26 via line 27. Tower 26 is mounted atop tank 24 and is open to the tank. Water from near the bottom of tank 24, having a temperature of about 95° to 110° F., is pumped via lines 28, 33, and 34 to an upper pair of spray bars 35 and 36. Slotted openings 37 and 38, which run the lengths of bars 35 and 36, respectively, open at an angle of approximately 20 degrees below horizontal. The water is pumped at sufficient pressure to expel a curtain of spray from each bar with sufficient force that the spray hits the opposite wall of tower 26. Thus, for example, if tower 26 measures, say, 24 inches on a side, each of bars 35 and 36 may have an internal diameter of about 2 inches and have a slot that is approximately one-sixteenth inch wide. Lines 28, 33, and 34 may all have an internal diameter of about two inches, and pump 39 may be sufficiently large to develop a pressure in pipes 33 and 34 of approximately 90 to 120 pounds per square inch gauge (psig).

Lower spray bars 29 and 30 have slotted openings that are identical to openings 37 and 38 in bars 35 and 36 and which also open at an angle of approximately 20 degrees below horizontal. Slot 40 in bar 30 is shown in FIG. 1. Most of the steam emitted from pipe 27 is cooled sufficiently by the water sprayed from bars 29, 30, 35, and 36 to cause it to condense. The hot condensate, mixed with the spray droplets, falls into chamber 24. The water in the upper region of chamber 24 therefore maintains a substantially higher temperature than that in the lower region, e.g., a difference of at least about 90 Fahrenheit degrees, between the two extremes.

The high temperature water near the top of the pool in tank 24 is continuously withdrawn via lines 41 and 42 and pump 43 and passed to boiler feed line 44. In case of failure of pump 43, a back-up pump 46 is automatically activated to deliver the water through line 45 to boiler feed line 44. Overflow line 51 prevents the level of water in tank 24 from rising into tower 26.

Make-up water is supplied to tank 24 when float 47 tells sensor 48 that the water level in tank 24 is too low and there is insufficient water in sump 14. The make-up water is tap water supplied through line 49 and solenoid valve 50 to line 20, immediately upstream of water softener 21.

If desired, the system can include purifying means (not shown), such as a filter, to remove contaminates from the water. Ideally this would be located in the city water lines 10 and 49. Alternatively, it could be located in line 20, between sump 14 and softener 21.

If the spent steam in line 27 is found to have an undersirably high level of contaminants, purifier means (not shown) also can be located in line 44, upstream of the boiler.

To give an example of the possible sizing of the various components of the system shown in the drawings, the following are the dimensions of the components of such a system designed for a yarn processing plant equipped with autoclaves and water cooled vacuum pumps. Tank 24 has a capacity of 1000 gallons. Holding tank 14 has a capacity of 300 gallons. Water softener 21 has a capacity of 500 gallons. Lines 19, 20, 23, and 49 all have an internal diameter of two inches. Spent steam line 27 has an internal diameter of six inches. The top pair of spray bars (35 and 36) are mounted 6 inches from the top of tower 26. Spray bars 29, 30, 35, and 36 have the dimensions suggested above, and the distance between the top pair of spray bars (35 and 36) and the bottom pair (29 and 30) is 24 inches. The overall tower height is 48 inches. The boiler (not shown) is a 350 H.P. boiler, consuming 700 gallons of water per hour. Generally, it is preferred that the capacity of the lower chamber of the reclaiming vessel be about 1.3 to 1.5 times the volume of water that the system's boiler is designed to consume in an hour.

A typical set of temperature conditions for the steam and water in the system just described might be as follows. The tap (or "city") water in lines 10 and 49 is at about 65° F. The warmed water in sump 14 is at approximately 95° F. The spent steam in line 27 is at about 250° F. The spray water withdrawn from the bottom of tank 24 through line 28 is at a temperature of 100° F. and is circulated by pump 39 at a rate of 7000 gallons per hour. The hot water withdrawn from the top of tank 24 through line 41 has a temperature of approximately 195° F.

The system of the present invention provides substantial savings of both energy and water, as compared to a prior art system in which (a) the used cooling water is passed through a cooling tower and recycled, rather than used as boiler feed water, and (b) the spent steam is vented directly to the atmosphere, rather than being condensed by being sprayed with the used cooling water. The spent steam can come from any equipment, not just autoclaves. Any system using cooling water and also venting steam into the atmosphere can possibly be improved by modifying the system according to the present invention.

I claim:

1. In a system comprising a source of tap water, a boiler to generate live steam, first equipment that receives the live steam generated by the boiler, uses it, and expels lower temperature spent steam, and second equipment that receives the tap water, uses it as a coolant, and expels the water at a higher temperature than when it was received, but not as high as 212° F., the IMPROVEMENT wherein the system includes a vessel comprising a lower chamber for holding a pool of water and an upper chamber for condensing steam, the upper chamber being located above the lower chamber and being open to the lower chamber, and the vessel being vented to the atmosphere, means for conducting the warmed water expelled from the second equipment to said lower chamber of the vessel, means for conducting the spent steam to the upper chamber and releasing it therein, means for conducting water from a first zone in the bottom half of the vessel's lower chamber to the vessel's upper chamber, spray means in the upper chamber for spraying the released steam with a sufficient quantity of said lower chamber water to cause a substantial portion of said steam to condense and fall into the pool of water in the lower chamber, and means for conducting water from a second zone in the vessel's lower chamber, which is above said first zone, to said boiler.

2. The system of claim 1 wherein the spray means is operable to create two, spaced-apart curtains of spray in the upper chamber, and the means for conducting the spent steam to the upper chamber is operable to release said steam in the region lying between said two curtains of spray.

3. The system of claim 1 further including tank means for collecting and holding said warmed water expelled from the second equipment prior to conducting it to said vessel, and further wherein said means for conducting the warmed water expelled from the second equipment is operable to deliver said water into the first zone in the vessel's lower chamber.

4. The system of claim 1 further including means for softening the warmed water expelled from the second equipment prior to conducting it to said vessel.

5. The system of claim 2 further including tank means for collecting and holding said warmed water expelled from the second equipment prior to conducting it to said vessel, and further wherein said means for conducting the warmed water expelled from the second equipment is operable to deliver said water into the first zone in the vessel's lower chamber.

6. The system of claim 2 further including means for softening the warmed water expelled from the second equipment prior to conducting it to said vessel.

7. The system of claim 3 further including means for softening the warmed water expelled from the second equipment prior to conducting it to said vessel.

8. The system of claim 2 wherein the spray means includes a first pair of horizontal pipes mounted on opposite interior walls of the upper chamber, above said steam release region, each pipe having one or more spray openings that face the opposite wall of the chamber, and a second pair of horizontal pipes mounted on opposite interior walls of the upper chamber, below said steam release region, each said pipe also having one or more spray openings that face the opposite wall of the chamber.

9. The system of claim 8 wherein the spray openings in said first pair of horizontal pipes are directed about 20 to 30 degrees below horizontal.

10. The system of claim 9 wherein the spray openings in said second pair of horizontal pipes are directed about 20 to 30 degrees below horizontal.

11. The system of claim 10 wherein each said horizontal pipe has a slotted spray opening along its length.

12. The system of claim 11 wherein the upper chamber has a horizontal cross-section that is substantially rectangular, the second pair of horizontal pipes is mounted on different walls than the first pair of horizontal pipes, and the means for conducting the spent steam to the upper chamber terminates in a vertical length of pipe that is open at the bottom.

13. The system of claim 12 further including tank means for collecting and holding said warmed water expelled from the second equipment prior to conducting it to said vessel, and further wherein said means for conducting the warmed water expelled from the second equipment is operable to deliver said water to the first zone in the vessel's lower chamber.

14. The system of claim 13 further including means for softening the warmed water expelled from the second equipment prior to conducting it to said vessel.

15. The system of claim 7 wherein the second equipment includes one or more apparatus selected from the group consisting of chillers, air compressors, and vacuum pumps.

16. The system of claim 14 wherein the second equipment includes one or more apparatus selected from the group consistng of chillers, air compressors, and vacuum pumps.

17. The system of claim 15 wherein the first equipment includes an autoclave.

18. The system of claim 16 wherein the first equipment include an autoclave.

* * * * *